United States Patent [19]

Galatis

[11] Patent Number: 4,488,503

[45] Date of Patent: Dec. 18, 1984

[54] BARGE CARRYING SHIP AND METHOD OF LOADING SAME

[76] Inventor: Telemachus N. Galatis, 35 Berkeley Ct., Baker St., London, England

[21] Appl. No.: 449,004

[22] PCT Filed: Mar. 31, 1982

[86] PCT No.: PCT/GB82/00100

§ 371 Date: Nov. 30, 1982

§ 102(e) Date: Nov. 30, 1982

[87] PCT Pub. No.: WO82/03365

PCT Pub. Date: Oct. 14, 1982

[30] Foreign Application Priority Data

Apr. 6, 1981 [GB] United Kingdom ..... 8110678

[51] Int. Cl.[3] ..... B63B 35/40; B63B 35/28

[52] U.S. Cl. ..... 114/260; 114/259; 114/72; 114/125; 114/256; 414/103; 414/138

[58] Field of Search ..... 114/258, 259, 260, 72, 114/73, 74 R, 26, 222, 125, 256; 414/103, 137, 138, 140

[56] References Cited

U.S. PATENT DOCUMENTS

| | | | |
|---|---|---|---|
| 2,513,004 | 6/1950 | Cooley | 114/74 R |
| 3,400,681 | 9/1968 | Clay | 114/260 |
| 3,559,787 | 2/1971 | Caillet | 114/72 |
| 3,738,302 | 6/1973 | Flajole | 144/72 |

FOREIGN PATENT DOCUMENTS

| | | | |
|---|---|---|---|
| 87688 | 7/1980 | Japan | 114/260 |

*Primary Examiner*—Trygve M. Blix
*Assistant Examiner*—Patrick W. Young
*Attorney, Agent, or Firm*—Dennison, Meserole, Pollack & Scheiner

[57] ABSTRACT

The invention pertains to a method of loading cargo-carrying barges into an ocean-going ship having a self-lowering capability and having facility for flooding at least one cargo-carrying space with water up to a Loading Water Line corresponding with the ballasted water line of the ship. The carrying barges are closed against entry of water, and each barge, such as B1, after being floated into the cargo-carrying space, is upended in the water and conveyed into a storage location where it is retained, for example by retaining rails 42,43. In consequence, a relatively large number of barges can be carried in the storage space.

9 Claims, 11 Drawing Figures

BARGE CARRYING SHIP AND METHOD OF LOADING SAME

This invention relates to a method of loading a cargo transport ship with water-borne cargo-carrying vessels preparatory to transportation of such cargo-carrying vessels by the ship, which method includes the steps of flooding a storage space within the transport ship and floating the cargo-carrying vessels into that space. The invention also relates to a transport ship equipped for loading by such method.

In recent years the search for more economic modes of cargo transportation has led to the introduction of designs of sea-going transport ships with facility for taking a number of loaded barges on board. Such systems of transportation afford a number of advantages, notably in simplifying the transfer of cargo from inland sites to an ocean transport ship via inland waterways and the eventual transport of the cargo to coastal or inland delivery points. By eliminating the off-loading of cargo from the barges into the transport ship and vice versa, important labour and energy cost savings are achieved and the speed and general convenience of the water-borne transportation exercise is enhanced.

In one known type of barge-carrying system, loaded barges are lifted from the water by lifting equipment at the stern of the transport ship and conveyed along the cargo decks by a conveyor (see e.g. the article entitled "Doctor Lykes" in Shipping World and Shipbuilder, September 1972, page 1045).

More recently, cargo transport ships utilising a so-called float-on cargo-loading principle have been built. These ships have a self-lowering capability whereby a cargo space can be flooded through the stern to allow direct access of floating cargo (see the article on the container freighter "Condock" in Mak Toplaterne Diesel Engine Journal, November 1980, page 37). By enabling cargo to be floated into the ship, the need for expensive lifting gear is eliminated. After loading the barges onto the transport ship it is debalasted to cause it to rise in the water and the cargo space is drained. The barges then lie in the transport ship as in a dry dock.

The number of barges of a given size which can be docked in a transport ship in this way is dependent on the length and width of the cargo space. In designing the transport ship the extent to which these dimensions can be increased is limited by numerous factors including of course the maximum permissible length and beam of the ship.

In order to permit a greater number of barges to be carried proposals have been made to make the transport ship of double-deck form and enable it to be immersed to the draught required for docking barges onto the upper as well as the lower deck. It has also been proposed to provide for storage of barges in superimposed tiers for providing a transport ship with an internal hydraulic water-lift whereby barges floated into the ship at a given level can be raised within the ship and suspended from the overlying deck. Further barges can then be stowed in an underlying tier. This proposal avoids the need for a second deck and avoids the need for the docking draught of the transport ship to be increased for taking on the upper tier of barges. The foregoing proposals are outlined in "Shipping World & Shipbuilder", June 1974, pp 599–602.

The present invention provides a method of cargo vessel transportation by a transport ship utilising the float-on loading principle, which method enables a more favourable relationship to be attained between the cargo carrying capacity of the transport ship and its main dimensions.

A method according to the present invention is defined in claim 1 hereof. The method is characterised in that use is made of closed cargo-carrying vessels which can be upended in the water without spillage of cargo from or entry of water into the vessels, and in that the vessels are thus upended and are brought in upended state into storage locations in said storage space where they are retained in upended state for transportation.

It is an important advantage of this method that many more cargo-carrying vessels can be carried than would be possible by the previously known methods in a transport ship of comparable main dimension characteristics. The vessels can be stored in close formation in adjacent parallel rows.

Because of the loaded state of the vessels, the energy required to displace them from their normal horizontal orientations into their upended state are not excessive. The required forces can be derived from a power unit of modest power output.

Because of the main function of the aforesaid cargo-carrying vessels in carrying cargo loads to and from the transport ship, the term "barges" will hereafter occasionally be used, for convenience, to refer to them. It is to be understood however that the vessels need not have any conventional barge geometry. The vessels are necessarily elongate but they can have any required longitudinal and transverse profiles. For example they can be of substantially cylindrical or rectangular cross-section over substantially their entire length. The vessels need not be of durable construction. They can be relatively inexpensive containers intended to be used only once or to be discarded after being used only a few times.

In order to avoid unnecessary waste of storage space in the transport ship the length of each barge is preferably such that in its upended state it extends over much the greater part of the height of the storage space. The barge length is preferably more than two-thirds and most preferably more than three quarters of that height.

The extent to which the potential benefits of the invention are realised depends of course on the storage density of the barges. An advantageous procedure is to hold a plurality of upended barges located in each of a plurality of storage lanes in the storage space. Of course the total cargo-storage space in the ship can be subdivided into a plurality of smaller spaces and in this case barges can be stored in the aforesaid manner in each of those spaces.

The barges preferably have a loading/unloading hatch or hatches confined to an end portion of the barge so that such hatch(es) remain above the water line when the barge is upended. Barges having hatches confined to one end can be conveniently filled with flowable cargo by pouring the cargo into the barges while they are supported in inclined position, e.g. on a ramp at a barge-filling terminal.

If the barge filling hatch(es) is (are) confined to an end of the barge as above referred to, efficient water-tight sealing of the hatches is not critical. It is preferable however in all cases for the barges to be water-tightly sealed. The carrying of sealed barges in quantity introduces an important safety factor into the operation of the transport ship. The sealed barges provide buoyancy forces assisting continued flotation of the transport ship in the event of hull damage causing flooding of a barge-carrying space. Moreover such damage to the transport ship is much less likely to result in irrecoverable loss of cargo or pollution of the sea by oil or other pollutant if this constitutes the cargo or any part of it.

The method is particularly advantageous in the carrying of flowable cargo, which may be a liquid material or a loose solid material such as coal.

It is recommended that the cargo space in the barges be substantially completely filled by flowable cargo, to restrict mobility of the cargo within the barges.

It is often desirable to use barges each having one or more internal voids which reduce the volume of the available cargo-carrying space in the barge and enable that volume to be substantially entirely filled with water or other material of similarly high or of higher specific gravity. Such a void can be defined by a tank or capsule which is removably secured in the barge and/or is of variable size. The location of said voids in the barges should be such that they do not significantly increase the energy required for upending the barges or make them unstable in their floating upended state.

In carrying out the invention the upending of the barges is preferably effected within or as they enter the transport ship. The depth of water which is required in the cargo entrance way to the transport ship need then only to be sufficient for the normal draught of the loaded barges and this gives more freedom of choice in respect of the design of the transport ship. Moreover the upending of the barges can conveniently be effected by mechanism carried by the transport ship. However it is within the scope of the invention to effect the upending of the barges in the vicinity, but externally, of the transport ship.

In certain embodiments of the method according to the invention, the barges are upended by or with the assistance of forces exerted on them by upending mechanism carried by the ship.

As an alternative or in addition to the use of mechanism which exerts external upsetting forces on the barges, buoyancy forces causing or assisting the upending movement can be created by expelling water from water-filled buoyancy tanks as hereinafter described.

After the barges have been located in their storage positions in the transport ship, the barge-supporting water in the barge storage space can be entirely or partly off-loaded from the ship. This is not essential. Depending on the size of the ship and its cargo-carrying capacity, the weight of the barge-supporting water may be very small in relation to the total load-carrying capacity.

The invention includes a cargo transport ship constructed and equipped for loading with cargo-carrying vessels by a method as hereinbefore described.

A cargo transport ship according to the present invention is defined in claim 8 hereof. The ship is characterised in that it has means for holding elongate cargo-carrying vessels located in upended state at storage locations in said space.

Such a ship can carry a substantially larger number of cargo-carrying vessels than can a ship of comparable size and proportions designed for docking floated-on cargo-carrying vessels in horizontal positions in the previously known manner.

Preferably there is a plurality of said storage locations in each of a plurality of parallel storage lanes in the storage space.

Conveying means is preferably provided as part of the transport ship equipment, for conveying unended vessels into the storage locations.

In preferred embodiments, the ship itself carries means for causing or assisting upsetting of said vessels into an upended state in the water in said space. Such upsetting means may operate in any of the ways hereinbefore referred to. Preferably the upending means consists of or includes mechanism which operates to apply external upsetting forces to the vessel. For example said mechanism may apply downward or upward force on one end of each vessel, or may exert on the vessel a couple which causes upending thereof. The said upsetting means can alternatively or in addition comprise means for supplying gas under pressure to expel water from barge buoyancy tanks as hereinbefore referred to.

Advantageously the ship is of closed type and the or each cargo-carrying space is a hold having at least one cargo entry door or hatch in a side of the ship.

Preferably there is a plurality of said holds which are separated by transverse bulkheads and there is barge-upending means and barge conveying and locating means in each of the holds. Other things being equal, division of the total hold area in the ship into separate holds is of value for safety reasons.

A particularly recommended design of transport ship, of which an example will be described in detail, is a design having the features defined in claim 16 hereof. The design provides for very convenient barge-handling and high density barge storage within one or more cargo holds.

The invention includes a cargo transport ship as above defined in combination with a plurality of cargo-carrying vessels designed so that they can be floated into the storage space(s) of said ship, unended therein without spillage of cargo from or entry of water into the vessels, and held located in upended state by said holding means. The cargo-carrying vessels can with advantage have any of the other features pertaining to such vessels as hereinbefore described.

Various embodiments of the invention will now be described by way of example and with reference to the accompanying diagrammatic drawings, in which.

The transport ship shown by FIGS. 1 to 6 has the following features:

The ship (see FIG. 1) has six cargo-carrying holds 1–6, separated by transverse bulkheads 7–11. Each of these holds extends across the full interior width of the ship between port and starboard side ballast tanks, and over the full vertical distance between bottom and deck structures of the ship.

Figure 1:
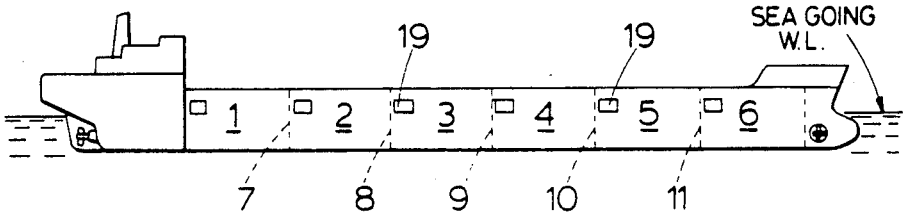
FIG. 1 is an elevation of a transport ship according to the invention.
Figure 4:
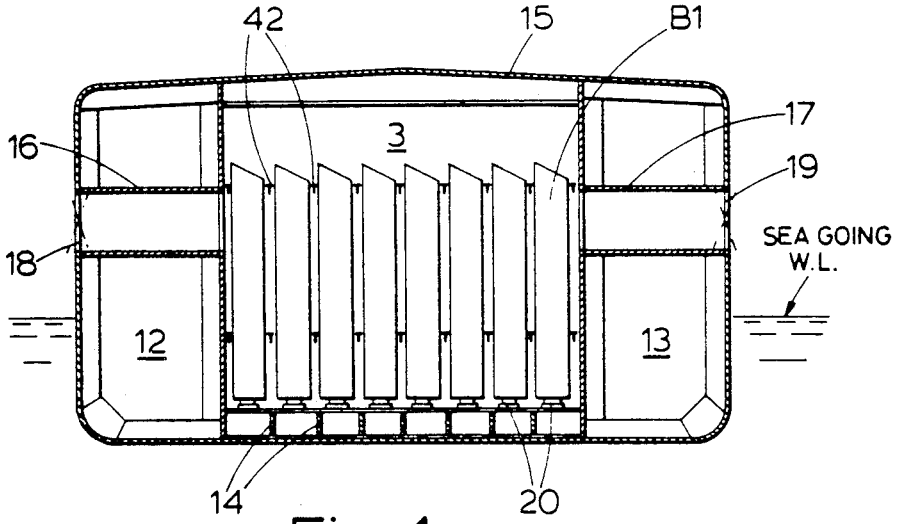
FIG. 4 is a view corresponding with FIG. 3 but with certain details omitted and shows a row of barges in storage positions.
Figure 2:
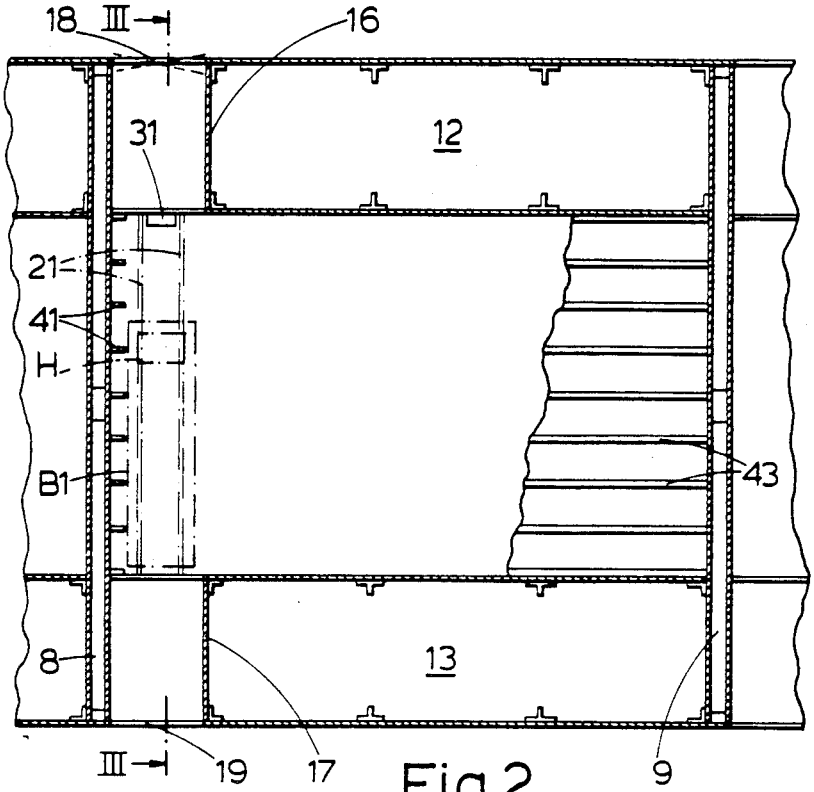
FIG. 2 is a sectional plan view of part of the ship on line II—II in FIG. 3.
Figure 3:
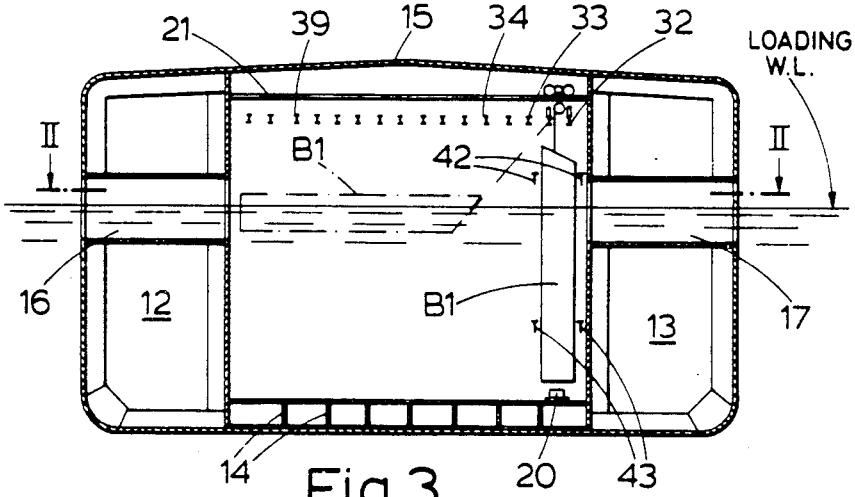
FIG. 3 is a sectional end elevation on line III—III in FIG. 2.

Referring to FIGS. 2 to 4 which are views of hold 3, it can be seen that this hold is defined by bulkheads 8,9 side ballast tanks 12,13 bottom structure 14 and deck structure 15. The hold has port and starboard loading hatches 16,17 located near its forward end and above the Sea Going Water Line which is denoted "Sea Going W.L." in FIG. 1. These hatches are fitted with watertight doors 18,19 respectively, in the ship hull. The other holds 1, 2 and 4 to 6 are similar to hold 3.

The ship is provided with ballast water pumps for pumping water into and out of the ballast tanks, and with pumps for pumping water into and out of the holds. The pumping systems can be as commonly used in oil tankers and need no detailed description.

Preparatory to on-loading barges, water is pumped into the ballast tanks and into the hold(s) to be loaded, to increase the draught of the ship up to an appropriate Loading Water Line, denoted "Loading W.L." in FIG. 3, between the top and bottom boundaries of the port and starboard loading hatches, and at the same time to flood said holds up to a corresponding level. Then one or both loading hatch doors of the hold(s) to be loaded can be opened to allow sealed barges to be floated in.

Within each of the holds 1–6 there is barge-handling gear for upending the barges floated into the hold and transferring the upended barges to storage locations, and means for supporting the upended barges in such locations during their carriage by the ship. If a plurality of holds is to be loaded with barges the holds can be loaded simultaneously so that the complete loading operation can be accomplished in a relatively short time.

When all the barges to be transported are on board and in their storage locations the ship is deballasted to decrease the draught to the Sea Going Water Line and the hatch doors are closed, ready for the journey.

After loading barges into any hold, the in-hold water can if desired be pumped out by the cargo hold pumps. If this water or a sufficient part of it is pumped out, the upended barges in that hold descend at their storage locations until they come to rest on underlying support pads 20 (FIGS. 3 and 4) on the bottom structure 14 of the ship.

The barge-handling and storage facilities in the different holds are the same. The following is a description with reference to FIGS. 2 to 6 of the handling and storage of barges in hold 3.

Figure 5:
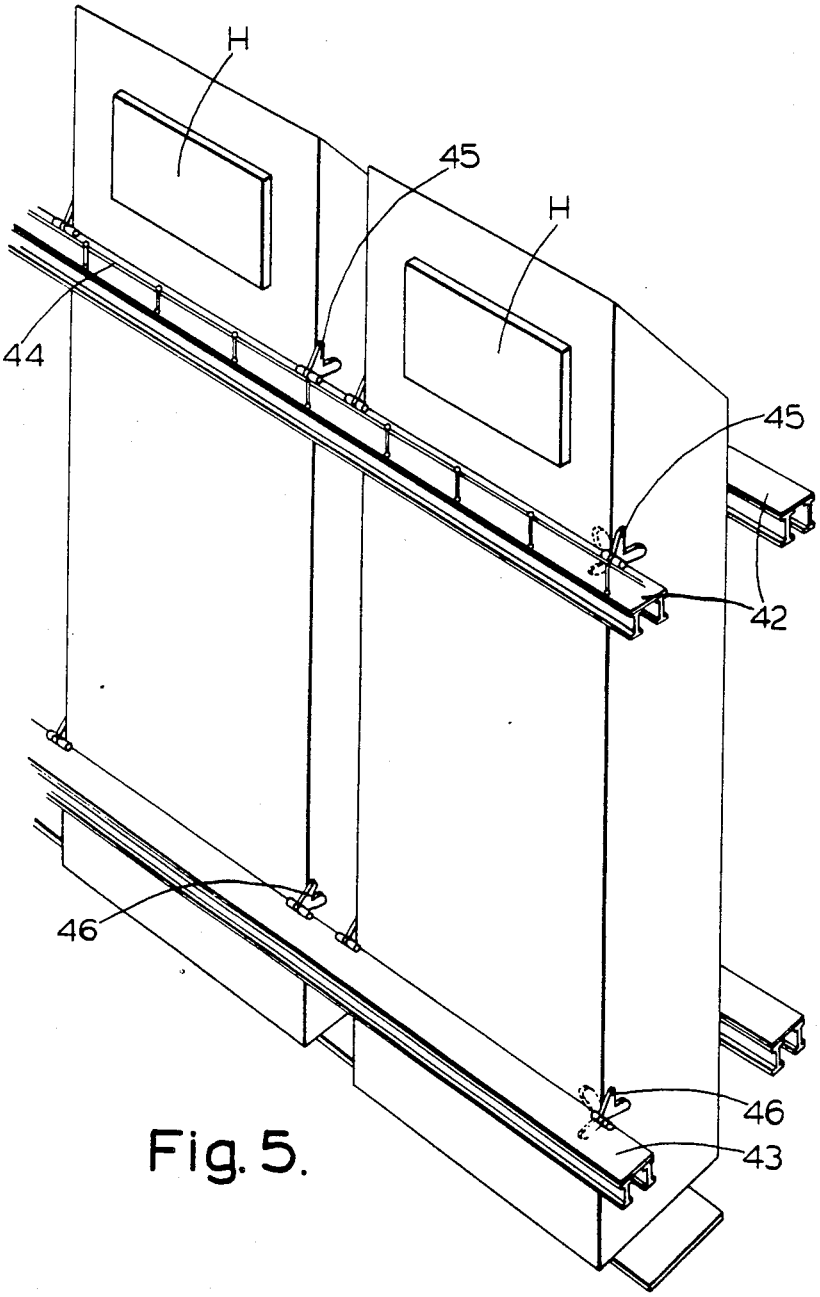
FIG. 5 is a detail of a barge storage lane with barges in position therein.

On entering the hold each barge lies transversely of the hold in the area between the loading hatches. That area is hereafter called "the float-in area". In FIGS. 2 and 3 a barge B1 is shown in broken line in this transverse position. The barge has an end loading and unloading hatch liquid-tightly sealed by a hatch cover H (FIGS. 2 and 5). The barge is upended in that float-in area and the floating upended barge is displaced into one or another of eight parallel storage lanes running in the longitudinal direction of the ship. In FIG. 3 the barge B1 is shown in full line in a storage position in one of the storage lanes. FIG. 4 shows one transverse row of eight barges, including barge B1, in storage position.

Rails 21 (see particularly FIGS. 2 and 6) are secured beneath the bottom of the deck structure 15 to form a transverse track across the top of the float-in area of the hold. A wheeled frame 22 (FIG. 6) is displaceable along this track by traction means (not shown) comprising a cable wound by electrically powered winches accommodated in housings near the ends of the track. The rails 21 and the wheels of frame 22 can be of rack and pinion form if required. The frame 22 carries suspension bars 23 which support short parallel rails 24. These rails form a section of a track for a carriage 25 on which two aligned cable sheaves 26,27 are rotatably supported together with an electric sheave-driving motor 28. The sheaves carry wire cables 29,30 whose free ends are attached to the forward end of each barge during or after its flotation into the float-in area of the hold. By winding in the cables, the forward end of the barge is raised from the in-hold water level and at a certain point in its tilting movement the aft end of the barge becomes submerged and commences to swing slowly downwardly until eventually the barge reaches a vertical position. The lifting forces are then released to allow the barge to float. Because buoyancy forces (although of reduced magnitude) remain operative during the upending operation the crane 26–28 does not at any time have to carry the entire loaded weight of the barge. The maximum loading forces on the crane are the forces required for initiating the upending of the barge and compensating for the temporary reduction of the buoyancy force until gravity brings the barge into its vertical floating position in the water. Thereafter the crane has merely to support the floating barge in its upended state and to overcome the drag resistance opposing movement of the upended barge through the water as the barge is displaced to its storage location. The crane can accordingly be of relatively small load-carrying capacity.

It is an advantage to provide buffer means 31 (FIG. 2) at the end of the float-in area where the barges complete their swing into a vertical position. Such buffer means can be located at the side of the hold as indicated at 31 in FIG. 2 or can project into the float-in area from the adjacent transverse bulkhead.

Once a loaded barge has been upended as above described the carriage 25 is displaced along the transverse rails 21 in order to bring the crane and the floating upended barge into alignment with the particular storage lane in which that barge is to be stored.

Figure 6:
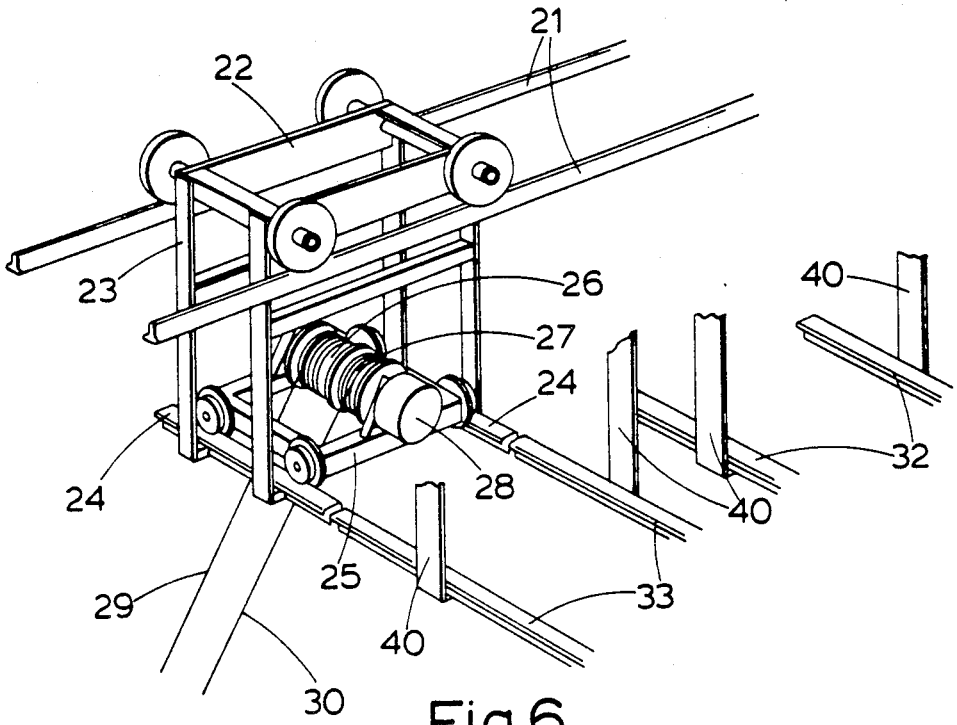
FIG. 6 is a detail of a barge-handling facility within the ship.

Along the tops of the eight longitudinal storage lanes there are corresponding longitudinal carriage tracks 32, 33, 34 . . . 39 (FIG. 3) formed by rails suspended from the deck structure 15 by suspension bars such as 40 (see FIG. 6). The crane-carrying frame 22 is displaced along the transverse track rails 21 to bring the crane carriage rails 24 into alignment with the longitudinal rails forming the selected longitudinal lane track (see FIG. 6).

In order to prevent swinging motion of the upended barge when the crane-carrying frame 22 is arrested opposite the selected longitudinal lane, abutments may be provided in the float-in area, opposite the longitudinal lanes, such abutments being selectively displaceable into working position from a retracted position within or close to the adjacent transverse bulkheads. By such means an upended barge being displaced along the float-in area can be arrested when it is in correct position for transportation along the selected longitudinal lane. Typical positions for such abutments are the positions 41 in FIG. 2. Such abutments can be operated by conventional hydraulic or mechanical mechanisms, for example as employed for successively operating vertically spaced supports for superimposed tiers of cargo in multi-tier cargo ships.

Instead of attaching two lifting cables 29,30 to the barges, a crane cable can be connected by a spreader to four connecting points on the barge, at the four corners of its fore or aft end. This method of attachment helps to stabilise the upended barge and reduces tendency for the barge to swing when first upended and during subsequent storage manoeuvres.

Associated with each lane track is overhead longitudinal traction means (not shown) comprising traction cables driven by electrically powered winches housed at the ends of the hold. After bringing the crane carriage 25 into alignment with the selected lane track as above referred to the carriage is coupled to the associated longitudinal traction means and the carriage is propelled along that lane track to carry the suspended barge along that lane to its storage position.

Each storage lane is defined by upper and lower pairs of parallel guide rails such as 42,43 (FIGS. 3 to 5). The upper guide rails 42 are located above the Loading Water Line whereas the lower guide rails 43 are below that water line, nearer to the bottom of the hold. Between neighbouring barge lanes there can be a single upper and a single lower guide rail structure, these structures being common to the two lanes. The upper guide rail structures and if desired also the lower ones can be fitted with a guard rail such as 44 and be used as a catwalk along which personnel can have access to the individual barge locations along the adjacent lane or lanes. Alongside each lane there are upper and lower series of barge spacers 45,46, supported by said guide rails. The spacers at different positions along the lane are independently displaceable from a working position into an inoperative position to allow a barge to move freely past such spacers. After displacing a first upended barge along a storage lane into a storage location in which one side of the barge lies against or near to abutments at the far end of that lane, the first spacers in the upper and lower series 45,46 are moved into their working positions in which they intrude into the barge lane. The crane cables 29,30 can then be uncoupled from that barge because the aforesaid end abutments and the spacers which have just been moved will keep the barge substantially upright. The next barge to be stored along that lane is brought up to those last moved spacers and then the next spacers along that lane are moved into working positions to support that second barge, and so on.

In the illustrated example, the upper spacers 45 are pivoted members which can be manually swung between the inoperative and working positions shown in broken and full line respectively in FIG. 5. The lower spacers, being below the in-hold water level, must be remotely actuated. This can be achieved by means of a mechanical linkage between each upper spacer and the corresponding lower one. The spacers could as an alternative all be remotely, e.g. electrically, actuatable.

The unloading of the ship involves the following reverse sequence of operations: The ship is ballasted to re-establish the Loading Water Line. If the hold(s) from which barges are to be unloaded was (were) entirely or partly emptied of water after taking in the barges, water is pumped into such hold(s) up to the same water line. The hatch doors of such hold(s) are then opened. By means of the travelling crane 26–28 the upended floating barges are removed one by one from their lanes and carried into the float-in area of the hold where the tension on the crane cables is relaxed to allow the barge to assume its normal horizontal floating position preparatory to being floated out of the hold through one of the hatches.

If it is desired to carry barges which do not contain cargo the barges are loaded with water before reaching the transport ship. They can therefore be readily on-loaded and off-loaded in the same way.

As an alternative or in addition to overhead lifting gear, a submerged haulage gear can be provided in the float-in area of each hold, powered by an electric or hydraulic motor, for performing or assisting the upending operation by pulling downwardly on an end of the barge. The energy required for upending a barge by exerting downward forces is less than when one end of the barge has to be pulled out of the water. Also the said alternative method requires appreciably less free space above the water-line.

As an indication of the appreciable increase in barge-carrying capacity made possible by the invention, a ship of the general form shown in FIGS. 1 to 3 of 220,000 tonnes Dead Weight, overall length 325.74 meters, beam 46.49 meters, and draught 26.02 meters and having five holds (i) to (v) of the following length and width dimensions, (in meters):

| | length | width |
|---|---|---|
| (i) | 40 | 25 |
| (ii) | 46.4 | 25 |
| (iii) | 40 | 25 |
| (iv) | 50 | 25 |
| (v) | 44.4 | 18.5 |

can carry in each hold at least 64 vertically orientated barges (eight lanes of eight barges) each measuring (overall) 16 meters in length, 4.35 meters in width and 2.9 meters in height, and carrying up to 150 tonnes of cargo. The ship can therefore carry at least 320 barges together carrying as much as 48,000 tonnes of cargo. By comparison, a ship of the same length and beam could not carry in a single tier much more than 53 of such barges in a horizontal orientation. The ship would have to be designed to store six or more tiers of horizontal barges in order to match the barge-carrying capacity of the said ship according to the invention wherein the 320 or more vertical barges are held in a single tier.

Figure 7:
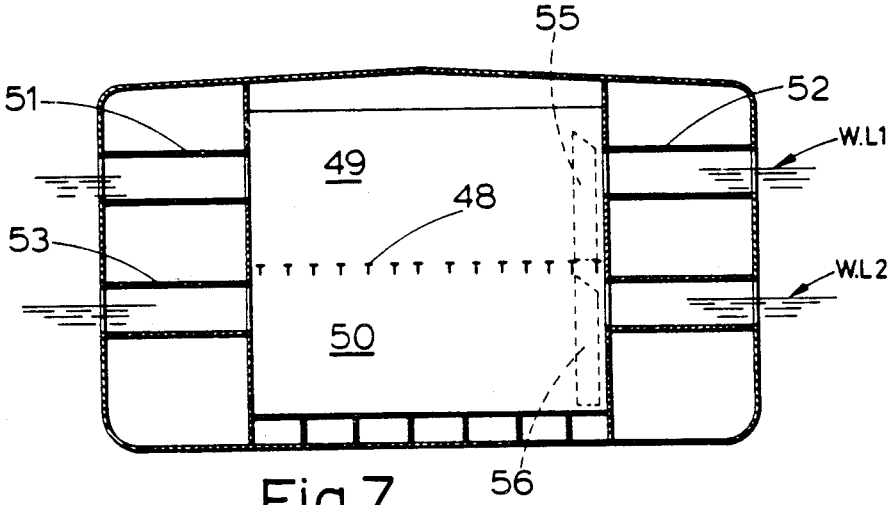
FIG. 7 is a sectional end elevation of another ship according to the invention.

FIG. 7 shows a ship according to the invention which can carry two tiers of upended barges. The ship is basically of the same construction as that described with reference to FIGS. 1 to 5 except that it is a taller ship, each of the hold spaces between transverse bulkheads is divided into two superimposed compartments by a between-deck, there are loading hatches for each compartment, and the ship can be ballasted to a draught suitable for floatin access to either compartment. The figure shows one of the large between-bulkhead hold spaces divided by between-deck 48 into upper and lower compartments 49,50. The compartment 49 has loading hatches 51,52 and is loaded while the ship is immersed to the water line marked W.L 1. Compartment 50 has loading hatches 53,54 and is loaded while the draught corresponds with water line W.L. 2. Each of the said compartments 49,50 has barge-handling gear and storage lanes like the holds of the ship shown in FIGS. 1 to 6. Two barges 55,56 are shown in storage positions in the upper and lower compartment respectively.

Figure 8:
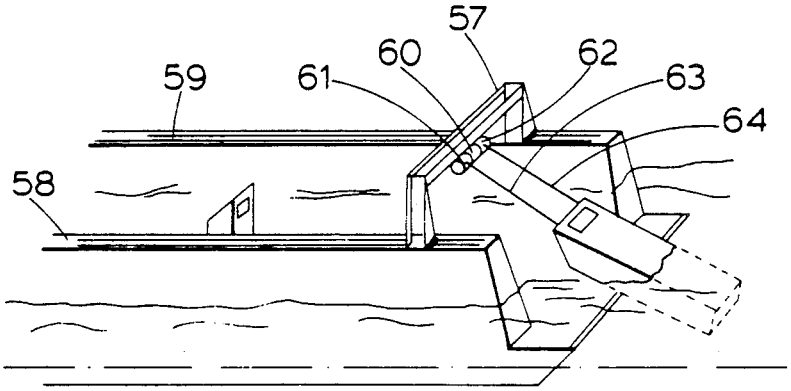
FIG. 8 is a pictorial representation of part of a third ship according to the invention.

FIG. 8 shows part of another ship according to the invention. The ship is of open type with water-tight stern door and a self-lowering capability permitting the open cargo-carrying space to be flooded through the stern when that door is open, so that barges can be floated directly into the ship. In these respects the ship is of a basic design known to naval architects and requires no detailed description. A ship of that basic design the "Condock" referred to earlier in this specification. The ship according to FIG. 8 is however equipped according to the present invention for upending barges in the in-ship water and holding them stored in upended state. The handling equipment includes a crane gantry 57 which straddles the cargo-carrying space and is displaceable by electric motors (not shown) along crane tracks 58,59 disposed along the sides of the ship hull. The gantry carries a crane comprising an electric motor 60 driving cable sheaves 61,62 for winding two cables 63,64 which are connected to the barges entering the ship preparatory to exerting the lifting forces which cause the upending of the barges. Within the cargo-carrying space there are parallel storage lanes like those in the holds of the ship shown by FIGS. 1 to 6. The crane 60–62 is displaceable along the gantry, i.e. tranversely of the ship, for bringing an upended barge into alignment with any selected storage lane before the gantry travels along the ship to carry the barge along that lane.

Figure 10:
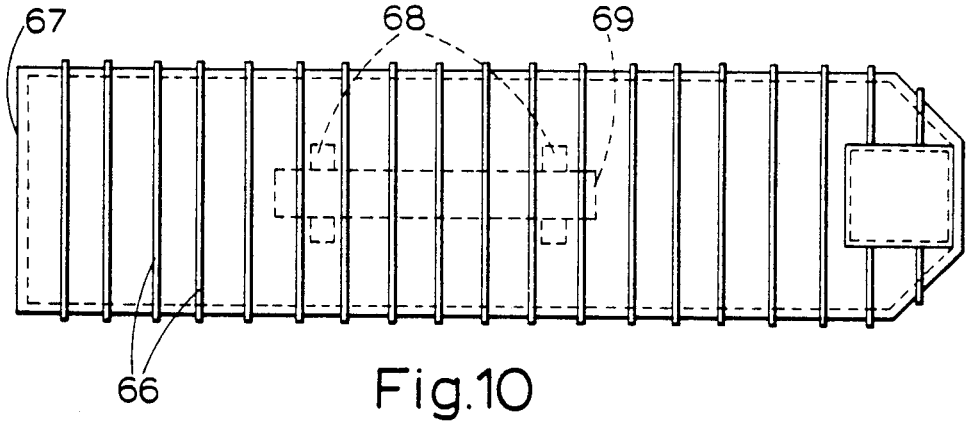

When using a ship as shown in FIG. 10 the barges can be upended as they float into the ship or after entry therein.

Figure 9:
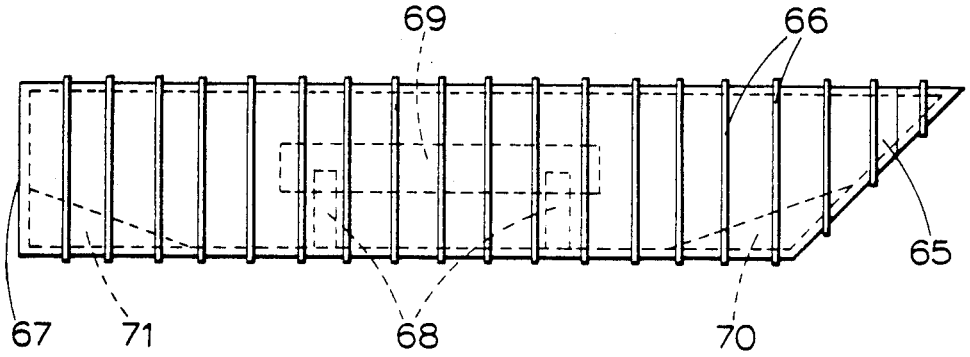
FIGS. 9 and 10 are side elevational and plan view respectively of a barge.

Barges for use with a ship according to the invention can for example have the general form represented in FIGS. 9 and 10. The barge shell can for example be composed of one or more skins 65 of fibre-reinforced synthetic polymeric material secured to a steel framework 66. The minimum strength specifications of the barges benefit from the fact that the barges are not required to support their cargo while lifted clear of the water.

The illustrated barge design provides a flat aft end 67 which when the barge is upended can bear stably on an underlying support such as a pad 20 (FIGS. 3 and 4) at a storage location. Within the barge there is a support structure 68 to which a gas-filled capsule 69 can be releasably secured. When such a capsule is fitted, the available cargo-carrying volume is reduced and it can be filled with water or another material having a similarly high or a higher specific gravity. The capsule can be expansible, e.g. inflatable or composed of telescoping sections, so that using one and the same capsule the free cargo space volume can be adjusted to a value such that the barge will float with the required freeboard when said free cargo space is entirely filled with cargo of a given specific gravity. The location of the capsule is such that the enclosed void does not prevent or appreciably oppose the upending of the barge or the maintenance of the barge in its upended state.

The barge may have interior bottom tanks such as 70 and 71 which can be water-filled for normal travel of the barge and each of which has valved gas inlet and water outlet openings. For causing or assisting movement of the barge from horizontal to vertical orientation or vice versa the water in a said tank can be displaced and replaced by $CO_2$ or other suitable gas by admitting a supply of the gas under pressure into the tank via the gas inlet. One or more suitable compressed gas containers may be carried by the barge itself or the source of gas under pressure may be located elsewhere, e.g. in the float-in area of a cargo hold of the transport ship.

Figure 11:
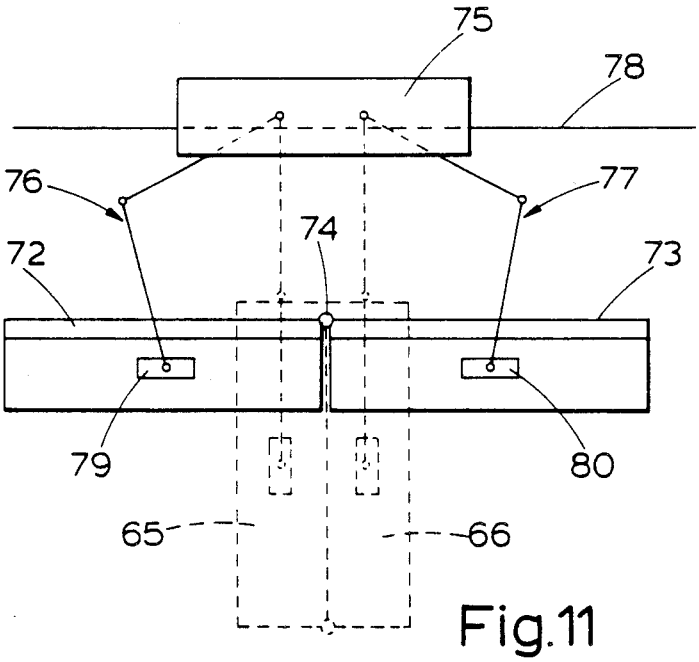
FIG. 11 is a representation of a barge upending mechanism.

As already indicated herein the invention can be carried out using elongate floating cargo-carrying containers which while essentially functioning as barges are not of any conventional barge geometry. FIG. 11 shows a pair of buoyant cargo-carrying containers which are of elongate rectanguloid form and illustrates a container-upending method quite different from that used in the ships described with reference to FIGS. 1 to 10. The pair of containers 72,73 shown in FIG. 11 are connected end to end by a transverse hinge joint 74. Within a mother ship according to the invention, e.g. a ship like that shown in FIGS. 1 to 6, or an open-type ship as described with reference to FIG. 8, there is tilting gear housed in a carriage 75 and comprising articulating double arms 76,77 extending downwardly from the carriage. The carriage travels along a track 78 suitably arranged within the mother ship. Each of the arms 76,77 comprises parallel elements carrying magnets such as 79,80 which engage the opposed sides of one of the containers. The operation of the lifting gear causes the arms 76,77 to extend and thereby exert a downward force on the floating containers where they are held by the magnets. In consequence the hinged ends of the containers are pushed down into the water. The containers eventually reach the upended positions represented in broken line. The containers may have their filling/discharge openings located in the ends of the containers remote from their hinge joint. The carriage 75 can be displaced along the track 78 while the upended containers are held by the arms, thereby to bring the containers into line with a storage lane in the ship. The upended containers can be carried along that lane by the same carriage if this is caused to move onto a suitable lane track. Alternatively support of the containers can be taken over by a second carriage which operates along the lane track.

A lifting gear comprising only one double arm such as 76 can be used for upending a single container.

A ship suitable for use in carrying out the present invention can be produced by converting an existing ship. For example a tanker without lateral access to its cargo holds can be converted by cutting lateral loading hatches in the hull and fitting water-tight doors, modifying the ballasting and bilge systems so as to give the ship the requisite self-lowering capacity and permit draining of water from the holds after float-in loading, and equipping the holds with the necessary barge-handling and storage facilities. If the holds of the original ship are divided by a longitudinal bulkhead, openings can be cut in this bulkhead opposite the side loading hatches to create a float-in area extending over the interior width of the hull with access to storage lanes on both sides of the longitudinal bulkhead. An existing open-type ship with self-lowering capability to permit direct flotation of barges into the interior of the ship can be converted simply by providing appropriate barge tilting and transfer gear and barge storage locations.

I claim:

1. A method of loading a cargo transport ship with loaded elongate water-borne cargo-carrying vessels preparatory to transportation of such cargo-carrying vessels by the ship, which method includes the steps of flooding a storage space within the transport ship, floating the cargo-carrying vessels into said flooded space, the improvement comprising swinging said vessels, while in the water, from their normal horizontal orientation into an orientation in which their longitudinal axes are substantially vertical while maintaining said buoyancy forces operative to support the vessel during the operation; and displacing the thus upended vessels into storage locations in said storage space while maintaining buoyancy forces operative to give support to said vessels during such displacement, and retaining the upended vessels in such storage locations for transportation by the ship.

2. A method according to claim 1, wherein the cargo-carrying vessls are floated into said storage space within the transport ship while they are in their normal horizontal orientation of use and the swinging of the vessels into their upended orientations takes place within said storage space.

3. A method of loading a cargo transport ship having a plurality of cargo storage spaces separated by transverse bulkheads, with loaded elongate water-borne cargo-carrying vessels preparatory to transportation of such loaded vessels by the ship, which method includes the steps of flooding each of said storage spaces within the transport ship; successively floating into each such flooded space, loaded elongate water-borne cargo-carrying vessels designed so that without spillage of cargo from or entry of water into the vessels they can be swung, moving said vessels, while in the water, from their normal horizontal orientation into an upended position in which their longitudinal axes are substantially vertical, floating said vessels into each such storage space through a cargo entry door in a side of the ship so that each such cargo-carrying vessel on arrival in said storage space is horizontally orientated with its longitudinal axis directed transversely of the ship; swinging each said vessel, following its said arrival, into a said upended orientation while the vessel remains in the water so that buoyancy forces remain operative to give support to the vessel during the upending operation; and displacing the successively floated-in and upended vessels, in their vertical orientation, into storage locations in storage lanes located in that storage space, such displacement being effected while such storage remains flooded so that buoyancy forces are also operative to give support to the vessels during such displacement, and retaining the upended vessels in such storage locations for transportation by the ship.

4. A cargo transport ship having at least one cargo storage space, means for ballasting the ship and flooding said space up to a level coinciding with the ballasted water line of the ship, a cargo entrance via which floating elongate cargo-carrying vessels can be floated into said flooded storage space, means by which said vessels after being floated into said space can be reoriented in the water into an upended position in which their longitudinal axes are substantially vertical, means defining storage locations in said cargo storage space, means for conveying the upended vessels into such storage locations, and means for holding the upended vessels at said storage locations during their transportation by the ship.

5. A ship according to claim 4, wherein there is a plurality of said cargo storage spaces separated by transverse bulkheads and wherein each said storage space has at least one said cargo entrance disposed in a side of the ship.

6. A ship according to claim 4, wherein successive sections along the ship are separated by transverse bulkheads and there are superimposed said storage spaces in each said section.

7. A ship according to claim 4, wherein there is a plurality of said cargo storage spaces separated by transverse bulkheads, wherein each said storage space has at least one said cargo entrance disposed in a side of the ship at an end region of such storage space, and wherein the said storage locations in each storage space are arranged in storage lanes extending in the lengthwise direction of the ship.

8. A ship according to claim 4, in combination with a plurality of elongate water-borne cargo-carrying vessels each having a length in excess of two-thirds of the height of a said cargo storage space of the ship, which vessels can be floated into a said storage space, upended in the water therein without spillage of cargo from or entry of water into the vessels, and held in upended state by said holding means in such storage space.

9. A ship according to claim 4, in combination with a plurality of elongate water-borne cargo-carrying vessels which can be floated into said at least one cargo storage space of said ship, upended in the water therein, and held in upended state by said holding means at said storage locations in such storage space, each said vessel having a length in excess of two-thirds of the height of a said storage space and having a loading/unloading hatch confined to an end portion of the vessel so that such hatch can remain above the water line when the vessel is upended.

* * * * *